US006308907B1

(12) United States Patent
Bartkowiak

(10) Patent No.: US 6,308,907 B1
(45) Date of Patent: Oct. 30, 2001

(54) METHOD FOR WINDING UP A THREAD

(75) Inventor: Klaus Bartkowiak, Herne (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/402,977

(22) PCT Filed: Mar. 22, 1999

(86) PCT No.: PCT/EP99/01922

§ 371 Date: Oct. 14, 1999

§ 102(e) Date: Oct. 14, 1999

(87) PCT Pub. No.: WO99/48786

PCT Pub. Date: Sep. 30, 1999

(30) Foreign Application Priority Data

Mar. 20, 1998 (DE) ..... 198 12 327

(51) Int. Cl.[7] ..... B65H 54/28
(52) U.S. Cl. ..... 242/477.2; 242/481.4
(58) Field of Search ..... 242/477.2, 477.3, 242/477.6, 477.9, 478.2, 481.4

(56) References Cited

U.S. PATENT DOCUMENTS 2,345,601 * 4/1944 Hickes ..... 242/477.3
3,656,291 * 4/1972 Key et al. ..... 242/477.3 X
4,771,960 9/1988 Yamamoto et al. .
4,948,057 8/1990 Greis .
5,112,001 * 5/1992 Yamamoto et al. ..... 242/477.2
6,065,712 * 5/2000 Mayer et al. ..... 242/477.3 X

FOREIGN PATENT DOCUMENTS 198 07 030 9/1998 (DE) .
0 302 461 2/1989 (EP) .
0 453 622 A1 10/1991 (EP) .
0 453 622 B1 10/1991 (EP) .
0 808 791 11/1997 (EP) .

* cited by examiner

*Primary Examiner*—Michael R. Mansen
(74) *Attorney, Agent, or Firm*—Alston & Bird LLP

(57) ABSTRACT

A method and apparatus for winding a continuously advancing yarn to a package formed on a tubular core, wherein a traversing yarn guide reciprocates the yarn within a traverse stroke and deposits it on the package at an angle of crossing. For its reversal at the ends of the traverse stroke, the traversing yarn guide is decelerated within each reversal range by a finite deceleration from a guiding speed and is again accelerated to the guiding speed by a finite acceleration. The acceleration and deceleration of the traversing yarn guide are controlled in such a manner that the reversal ranges of the traverse strokes become greater in length as the diameter of the package increases.

15 Claims, 3 Drawing Sheets

METHOD FOR WINDING UP A THREAD

BACKGROUND OF THE INVENTION

The present invention relates to a method and apparatus for winding a continuously advancing yarn to form a yarn package.

When winding the yarn to form a package, it is desirable to achieve a stable package build, a uniform packing density, as well as satisfactory unwinding properties in a subsequent further processing. In this connection, the end faces of such packages may extend in a normal plane, so that cylindrical packages result, or they may be inclined relative to this normal plane, so that a biconical package is wound. During the winding of the packages, the problem arises that the yarn reversal at the package edges causes a mass accumulation which leads to hard package edges or a bead-type package edge.

EP 0 453 622 discloses a method and an apparatus, wherein a traversing yarn guide performs a relatively high deceleration and acceleration in the reversal region. This results in an undefined yarn deposit in the reversal region. In the case of too high decelerations and accelerations, layers of yarn slip in the package edge region, which lead to an undefined buildup of the package edges. However, if the decelerations and accelerations of the traversing yarn guide are performed too slowly, a relatively large mass accumulates on the package edges.

It is accordingly an object of the invention to provide a method and an apparatus for winding a yarn to a package, wherein the yarn is deposited in the edge region with a minimal mass accumulation.

SUMMARY OF THE INVENTION

The above and other objects and advantages of the present invention are achieved by the provision of a method and apparatus wherein the advancing yarn is guided onto a rotating core by a traversing yarn guide so that during each traverse stroke the traversing yarn guide is accelerated by a predetermined acceleration to a guiding speed within a reversal range at one end of the traverse stroke, and decelerated from the guiding speed by a predetermined deceleration within a second reversal range at the opposite end of the traverse stroke. Also, the acceleration and the deceleration of the yarn guide are controlled such that the reversal ranges of the traverse strokes become greater in length as the diameter of the package increases.

During the traversing, the yarn deposit occurs by a speed function of the traversing yarn guide. This speed function is characterized by three stages. First, starting from a reversal point, the yarn guide must be accelerated to a guiding speed. The distance covered by the yarn guide, until it reaches the desired guiding speed, is defined as the reversal range. Subsequently, the yarn guide moves at the guiding speed to the opposite end of the traverse stroke. The distance covered in this case is referred to as the linear length. At the opposite end, the yarn guide is decelerated from the guiding speed such that its speed is zero in the opposite reversal point. The distance covered during the deceleration phase is likewise defined as a reversal range. Thus, the two reversal points result in the defined length of the traverse stroke by adding these three stages. The reversal range of the yarn guide is defined essentially by the controlled acceleration or deceleration of the yarn guide. The method of the present invention therefore uses precisely the acceleration or deceleration of the yarn guide to influence the yarn deposit. To this end, the acceleration and deceleration are controlled such that the lengths of the reversal ranges continuously increase, as the diameter of the package becomes larger. With that, it is accomplished that with an increasing package diameter, the mass accumulation becomes less in the edge region, and that thus prevents the formation of bead-type package edges. The mass accumulation in the yarn reversal develops from the fact that the varied speed of the traversing yarn guide makes it necessary to deposit on the package surface a larger mass of yarn per unit time. The shorter the reversal range, the smaller is the accumulation of masses. The yarn deposit within the reversal range, however, remains stable, since the surface of a cylinder with a larger diameter requires a yarn reversal with a larger radius.

In a particularly advantageous further development of the invention, a minimum length of the reversal range is determined for each package diameter that ensures a stable yarn layer on the package surface. Thus, it is possible to minimize mass accumulation in the reversal ranges during the entire winding cycle. This variant of the method is based on the knowledge that it is possible to deposit the yarn within the reversal range on the package surface at a minimal radius without the yarn dislodging on the package surface.

Since the minimum length of the reversal range depends essentially on the minimal radius of curvature of the yarn deposit and the respective angle of crossing, a variant of the method is especially advantageous wherein a continuous determination of the minimum length of the reversal range is made such that the yarn layer is prevented from slipping on the package surface. In this instance, it is possible to compute the minimal radius of curvature from the quotient of the package diameter and twice a coefficient of friction of the package surface. The coefficient of friction of the package surface is for textile yarns in a range from 0.2 to 0.6. This would result, for example, with a package diameter of 200 mm in a minimal radius of curvature of the yarn deposit within the reversal length from 167 mm to 500 mm.

To attain a high flexibility during the winding of the yarn, the minimum length of the reversal range is continuously computed by means of a control device and converted into control signals for controlling the acceleration and deceleration of the traversing yarn guide.

In this connection, it will be especially advantageous, when the package diameter is continuously determined and input to the control unit for computing the minimum length of the reversal range. Since the coefficient of friction of the package surface depends essentially on the yarn type and the traversing program, it is possible to store same as a value in the control unit. Likewise known from the traversing program and stored in the control unit is the wound angle of crossing of the yarn. Thus, the control unit that is formed, for example, by a microprocessor, continuously computes the minimum length of the reversal range. The computed value is then converted directly into control signals to control a drive of the traversing yarn guide accordingly.

The method of the present invention can be used for winding the yarn both in a random wind with a constant angle of crossing and in a precision wind with varied crossing angles.

In a further advantageous modification, the guiding speed of the traversing yarn guide is variable. Thus, it is possible to produce within a double stroke a different yarn deposit in each single stroke. Furthermore, it is possible to realize an advantageous combination with a ribbon breaking method. A ribbon is defined as a phenomenon of the package, wherein unidirectional yarn lengths overlie more or less in successively wound layers of the yarn. The symptoms of such ribbons are normally prevented in that the guiding speed or the traversing speed that is expressed as a number of reciprocating movements (double strokes) of the traversing yarn guide per unit time, is decreased and increased constantly, for example, between an upper and a lower limit. As a result of coordinating variations in the reversal ranges and a ribbon breaking, it is possible to realize a still better stabilization of the yarn layers in the edge region of the package.

In a further, preferred variant of the method, the length of the traverse stroke is variable. With that, it is possible to avoid a buildup of high edges even in the case of adjustments to slow accelerations and decelerations. In this connection, any kind of stroke modification in combination is possible for varying the reversal stroke. A further advantage lies in that it is possible to compensate substantially for the change in the yarn tension that is caused by the stroke modification. When winding a package, it is especially important that a uniform tension be present over the yarn length and over the length of the package. This will also improve the unwinding properties of the package.

The guiding speed of the yarn guide may be smaller or greater before reversing the movement than after reversing the movement. This variant of the method is especially suited for influencing the package build within the linear length of the traverse stroke. However, an increase in the guiding speed in the linear range without changing the deceleration would automatically lead to a lengthening of the reversal range. With that, it becomes also possible to change the length of the reversal range solely by controlling the guiding speed.

BRIEF DESCRIPTION OF THE DRAWINGS

Some of the objects and advantages of the present invention having been stated, others will appear as the description proceeds when considered in conjunction with the accompanying drawings, in which.

DETAILED DESCRIPTION OF THE PREFERRED EMBODIMENTS

Figure 1:
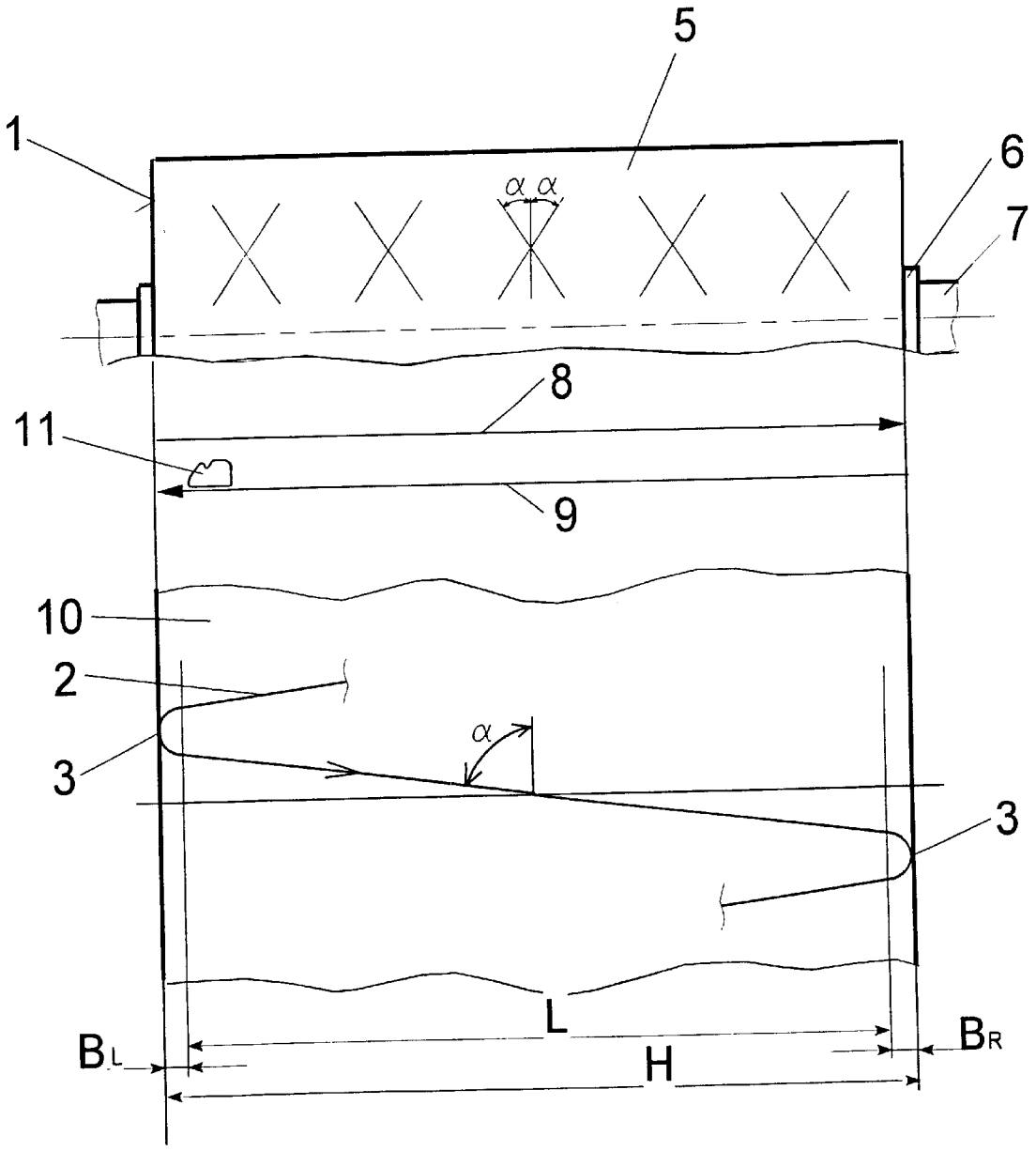
FIG. 1 shows a yarn deposit on a package during a traverse stroke.

FIG. 1 shows a yarn deposit on a package during a traverse stroke. The upper half of the Figure shows a package 5. The package 5 is wound on a tubular core 6. To this end, the core 6 is coaxially mounted on a winding spindle 7. The package 5 with end faces 1 is cylindrical and wound at a constant crossing angle α. However, the package 5 may also have a biconical shape or any desired shape. The package 5 could also be wound in any desired kind of wind, such as, for example, random wind, precision wind, or step precision wind, as well as combinations thereof. To deposit a yarn on the package, a friction roll not shown or the winding spindle 7 directly drives the package 5. Shortly before being deposited on the package, the advancing yarn is traversed by a yarn guide 11 in the direction of movement 8 from the left package end to the right package end, and in the direction of movement 9 from the right package end to the left package end. This sequence of movements is described as double stroke of the traversing yarn guide 11.

The traversing yarn guide could be driven, for example, by a linear drive or by a belt drive. In this instance, the linear drive or belt drive connects, for example, to a stepping motor. This kind of connection would then facilitate a precise control of the movement of the yarn guide via a programmable control unit. The lower half of FIG. 1 shows a yarn layer 2 that is deposited during a traverse stroke on a package surface 10. A reversal point 3 at each end defines the traverse stroke H that is equal to the wound length of the package. The reversal point 3 is the position in which the yarn guide has no speed. If one starts with the traverse stroke on the left side of the package as shown in FIG. 1, the yarn will initially be traversed at a constantly increasing crossing angle within the reversal range $B_L$. As soon as the yarn guide is accelerated to a guiding speed, that is predetermined for traversing the yarn on the package surface, the yarn will be deposited at a constant crossing angle α. This stage is described as linear length L. At the right end of the package, the traversing yarn guide 11 is decelerated such that it has again zero speed in reversal point 3. Consequently, the yarn is deposited in reversal range BR at a constantly decreasing crossing angle α. With that, it becomes clear that the package edges formed at the ends of the traverse stroke depend essentially on the yarn deposit within the reversal range B. The reversal ranges B are determined exclusively by the acceleration and deceleration of the traversing yarn guide. Thus, the yarn layer within the reversal range relates directly to the deceleration and acceleration of the traversing yarn guide. A radius of curvature p defines the yarn layers in the reversal ranges.

Figure 2:
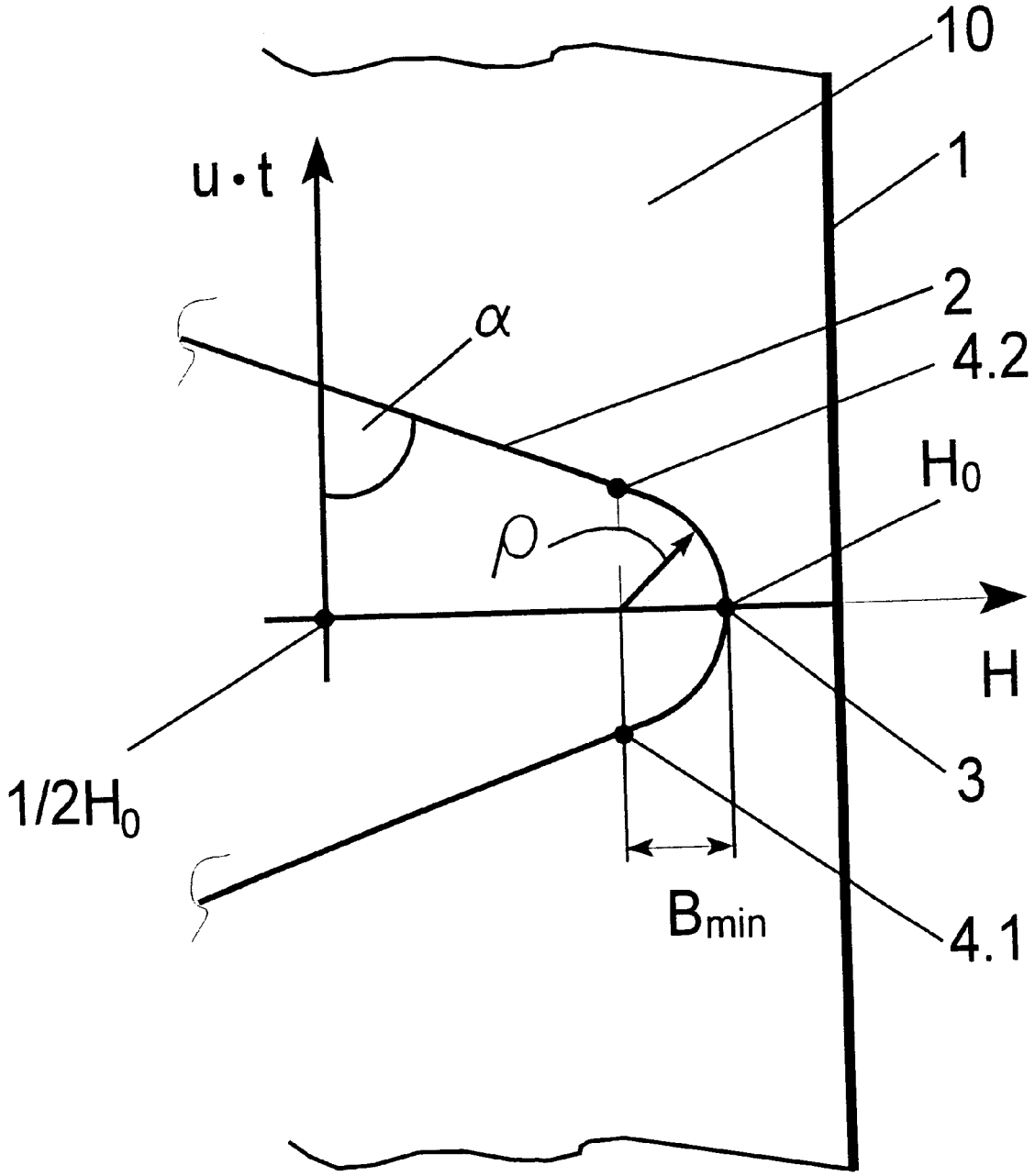
FIG. 2 shows a yarn deposit on the package surface in the reversal range.

To this end, FIG. 2 shows a yarn layer 2 on package surface 10 in the right-hand reversal range of a package. Through reversal point 3, the abscissa of a diagram is drawn. This abscissa represents the length of traverse stroke H. The ordinate of the diagram is drawn in the center of the traverse stroke and points in the circumferential direction of the package. Plotted thereon is the circumferential path u·t, where u is the circumferential speed and t the time. The reversal point 3 marks the end of the respective traverse stroke and is indicated in FIG. 2 at Ho. Thus, the ordinate intersects the abscissa at point ½ $H_o$. The yarn layer 2 within reversal range B is defined by the radius of curvature ρ. Between the ordinate and the yarn layer 2, the angle of crossing a is entered. The traversing yarn guide thus moves at the guiding speed to the beginning of the reversal range. In point 4.1, the traversing yarn guide starts to decelerate until reversal point 3. From reversal point 3 to point 4.2, the yarn guide is accelerated.

From the arrangement shown in FIG. 2, it is possible to derive a relationship between the radius of curvature p of the yarn layer, the crossing angle a, and the reversal range B. The reversal range B can be computed from the equation $$B=\rho\cdot(1-\cos\alpha).$$

The smallest depositable radius of curvature of the yarn layer, which does not result in a slipping yarn layer, can be computed from the equation $$\rho_{min}=D/(2\cdot\mu).$$

In this equation, D is the package diameter and p the coefficient of friction of the package surface. Thus, with an even package surface at an increasing package diameter, it is possible to deposit a yarn layer at an always only increasing radius of curvature without the yarn layer slipping on the package surface. In the case of textile yarns and standard traversing programs, the coefficients of friction range from 0.2 to 0.6. Thus, the minimum length of the reversal range can be computed from the equation $B_{min}=D\cdot(1-\cos\alpha)/2\mu$.

This computation can be continuously performed, for example, by the control unit of a stepping motor that drives the traversing yarn guide. From the calculated minimum length of the reversal range, the control unit generates control signals for activating the stepping motor. With that, the traversing yarn guide is subjected to a deceleration and an acceleration that lead to a minimum radius of curvature and, thus to a minimum length of the reversal range. With that, the yarn length deposited per unit time is reduced to a minimum.

Thus, the method of the present invention facilitates winding of a yarn to a package with a more uniform mass distribution on the package surface even without a stroke modification. To further equalize the packing density of the package buildup, one may perform in addition a stroke modification, i.e., a variation in the traverse stroke. Likewise, it is possible to vary the guiding speed according to a desired time program, in an effort of breaking a ribbon, i.e., avoiding ribbon winds.

Figure 3:
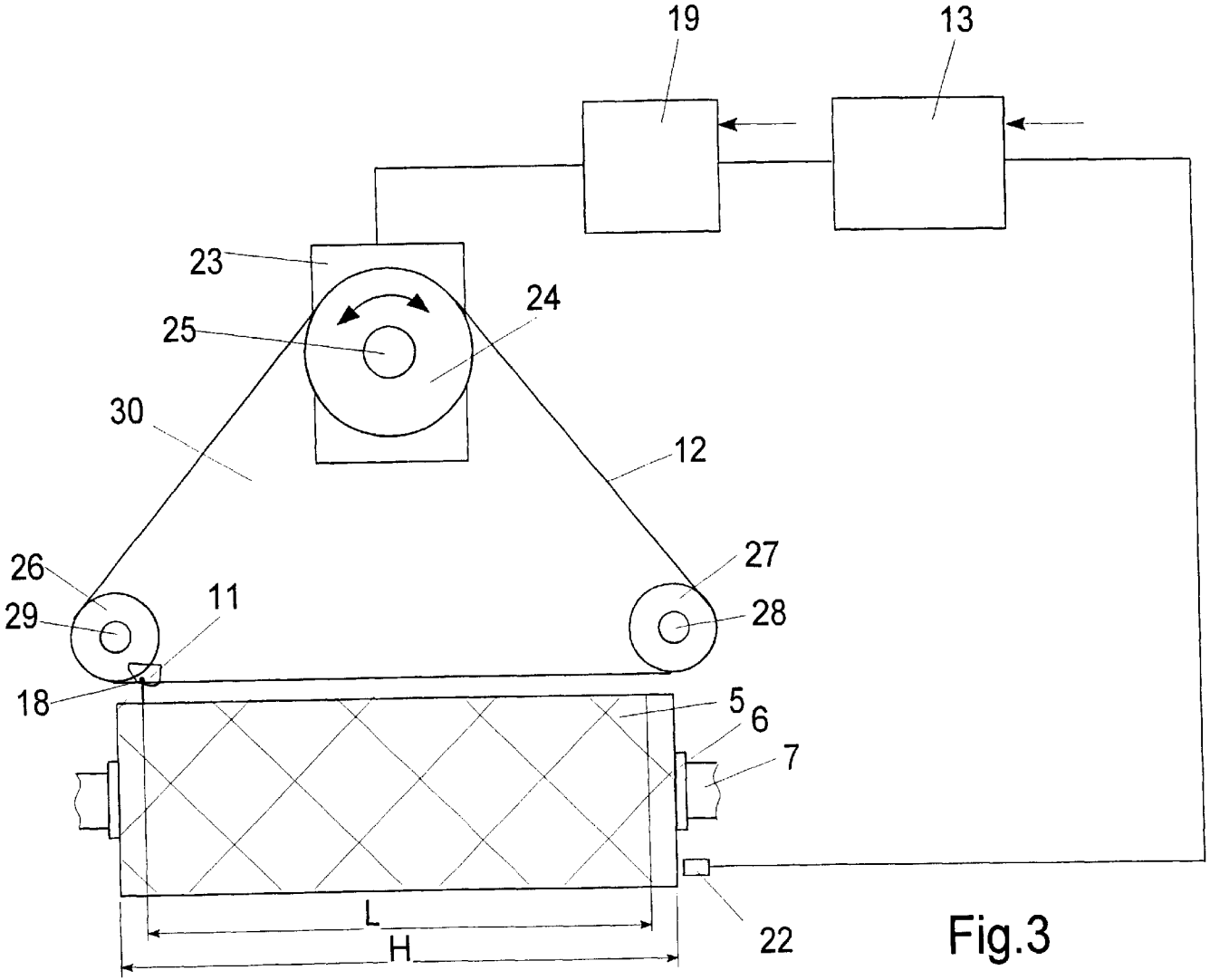
FIG. 3 shows an embodiment of an apparatus for carrying out the method of the present invention.

FIG. 3 shows an embodiment of an apparatus for carrying out the method of the present invention. In this apparatus, a belt drive 30 reciprocates the traversing yarn guide 11 within a traverse stroke H. The belt drive 30 is formed by belt pulleys 26, 27, and 24. A belt 12 looping around belt pulleys 26, 27, and 24 mounts the traversing yarn guide 11 and reciprocates it between belt pulleys 26 and 27. The belt pulley 26 is supported for rotation about an axle 29, the belt pulley 27 is supported for rotation about an axle 28. The belt pulley 24 is connected to a drive shaft 25 that is driven in both directions by means of an electric motor 23, for example a stepping motor. A controller 19 activates electric motor 23. The controller 19 connects to a control unit 13.

A winding spindle 7 mounting tube 6 extends parallel to the belt between belt pulleys 26 and 27 below the belt drive. The package 5 is wound on tube 6. The rotational speed of the winding spindle 7 is measured by means of a rotational speed sensor 22 and supplied to control unit 13. It is possible to adjust the ratio of traversing speed to circumferential speed of the package. Since the winding spindle 7 forms part of a takeup device that drives the package 5 at a constant circumferential speed, it is possible to compute from the rotational speed the respective wound diameter of the package. This computation is performed within the control unit 13. The control unit 13 has a data input and a data storage for receiving the coefficients of friction of the package surface and the crossing angles of the package wind. Based on the stored data as well as the continuously measured rotational speed, the control unit 13 can continuously compute the minimum length of the reversal ranges at the ends of the traverse stroke. The control unit converts the computed values into control signals and supplies same to the controller 19. The controller 19 activates the electric motor 23 accordingly, so that the traversing yarn guide 11 is subjected to an acceleration or deceleration, which ensures that the minimum length of the reversal range is maintained.

What is claimed is:

1. A method of winding a continuously advancing textile yarn into a core supported package, comprising the steps of guiding the advancing yarn onto a rotating core by a traversing yarn guide which moves within a traverse stroke to form a yarn package of increasing diameter, and so that during each traverse stroke the traversing yarn guide is accelerated to the guiding speed within a reversal range at one end of the traverse stroke, and decelerated from the guiding speed within a second reversal range at the opposite end of the traverse stroke, determining a particular length of the reversal ranges of the traverse strokes, which is necessary to provide a defined buildup of the package edges, wherein said particular length becomes greater in length as the diameter of the package increases, and controlling the acceleration and the deceleration of the yarn guide according to said particular length of the reversal ranges.

2. The method as in claim 1, wherein the controlling step includes continuously determining the package diameter and continuously determining for the then actual package diameter a minimum length of the reversal range ($B_{min}$), which ensures a stable yarn layer on the package surface, and generating from the determined minimum length a control signal for controlling the acceleration and deceleration of the traversing yarn guide.

3. The method as in claim 2, wherein the continuously determined minimum length of the reversal range ($B_{min}$) is defined by a radius of curvature ($\Delta_{min}$) of the yarn layer in the reversal range and the respective angle of yarn crossing ($\forall$), with the radius of curvature having a value at the respective package diameter (D) so that the yarn layer is prevented from slipping on the package surface.

4. The method as in claim 3, wherein the minimum radius of curvature ($\rho_{min}$) is determined from the quotient of the package diameter (D) and twice the coefficient of friction ($\mu$) of the package surface.

5. The method as in claim 4, wherein that the minimum length of the reversal range ($B_{min}$) is determined by the equation $B_{min}=\rho_{min}(1-\cos\alpha)$, where $\rho_{min}$ is the minimum radius of curvature and a the angle of yarn crossing.

6. The method as in claim 5, wherein the controlling step includes a control unit which continuously determines the package diameter and determines for the then actual package diameter a minimum length of the reversal range and generates therefrom control signals for controlling the acceleration and deceleration of the traversing yarn guide.

7. The method as in claim 6, wherein the coefficient of friction of the package surface is stored in the control unit, and the angle of yarn crossing on the package surface is determined by a traversing program that is provided by the control unit.

8. The method as in claim 2, wherein the guiding step proceeds so as to produce varying crossing angles of the yarn layer, and wherein at each change of the crossing angle the minimum length of the reversal range is determined.

9. The method as in claim 1, wherein the controlling step includes varying the guiding speed of the traversing yarn guide for purposes of breaking a ribbon.

10. The method as in claim 1, wherein the controlling step includes varying the length of the traversing stroke for purposes of a stroke modification.

11. The method as in claim 1, wherein the controlling step includes, before reversing the movement of the yarn guide, providing for the guiding speed to be different from the guiding speed after reversing the movement of the yarn guide.

12. The method as in claim 1, wherein the controlling step includes providing for the guiding speed of the traversing yarn guide to be controllable within the traverse stroke.

13. A method of winding a continuously advancing textile yarn into a core supported package, comprising the steps of guiding the advancing yarn onto a rotating core by a traversing yarn guide which moves within a traverse stroke to form a yarn package, and so that during each traverse stroke the traversing yarn guide is accelerated to a guiding speed within a reversal range at one end of the traverse stroke, and decelerated from the guiding speed within a second reversal range at the opposite end of the traverse stroke, continuously determining the package diameter and continuously determining a minimum length of the reversal ranges which ensures a stable yarn layer on the package surface for the then actual package diameter, and controlling the acceleration and the deceleration of the yarn guide during each traverse stroke to provide the determined minimum lengths of the reversal ranges.

14. An apparatus for winding a continuously advancing textile yarn into a core supported package comprising means for rotating the core to wind the yarn thereabout at a substantially constant rate, a yarn guide moveable axially with respect to the core for guiding the advancing yarn onto the core, and a drive for traversing the yarn guide over the package length, with the drive being controllable in speed and in acceleration by a controller which is connected to a control unit that continuously determines during the winding cycle for the then actual package diameter a minimum length of the reversal range, and generates therefrom control signals for controlling the acceleration and deceleration of the traversing yarn guide.

15. The apparatus as in claim 14, wherein the control unit is connected to a rotational speed sensor that measures the rotational speed of the package, and that the control unit has a data input for receiving coefficients of friction of the package surface and angles of yarn crossing of the package wind, and a data storage for storing the received coefficients and angles.

* * * * *